United States Patent [19]

Gayton

[11] Patent Number: 5,025,825

[45] Date of Patent: Jun. 25, 1991

[54] RISER SPOUT DIVERTER ASSEMBLY

[75] Inventor: David E. Gayton, Bay Village, Ohio

[73] Assignee: Moen Incorporated, Elyria, Ohio

[21] Appl. No.: 538,750

[22] Filed: Jun. 15, 1990

[51] Int. Cl.[5] ..... E03C 1/02

[52] U.S. Cl. ..... 137/119; 4/192; 137/801

[58] Field of Search ..... 4/192; 137/119, 801

[56] References Cited

U.S. PATENT DOCUMENTS

| | | | |
|---|---|---|---|
| 2,949,933 | 8/1960 | Moen | 137/119 |
| 3,056,418 | 10/1962 | Adams et al. | 137/119 |
| 4,008,732 | 2/1977 | Fichter et al. | 137/119 |
| 4,134,419 | 1/1979 | Richetti | 137/216 |
| 4,457,342 | 7/1984 | Moen | 137/801 |

*Primary Examiner*—Gerald A. Michalsky
*Attorney, Agent, or Firm*—Kinzer, Plyer, Dorn, McEachran & Jambor

[57] ABSTRACT

A rising type faucet assembly, for example for use in the kitchen, has a support base adapted to be mounted on a sink deck and a spout housing and spout mounted on the support base. An elongated sleeve extends within the support base and is attached to the spout housing. The sleeve includes means cooperating with the support base for releasably positioning the sleeve and spout housing at a raised height above the support base. A water inlet is connected to a lower end of the sleeve. A diverter assembly is positioned at an upper end of the sleeve. The lowermost position of the diverter assembly, when the spout housing and spout are positioned directly on the support base, is above the sink deck. There is an inlet water passage in the sleeve between the inlet and the diverter assembly. There is an auxiliary outlet in the sleeve at a lower portion thereof and an outlet water passage in the sleeve between the diverter assembly and outlet.

5 Claims, 1 Drawing Sheet

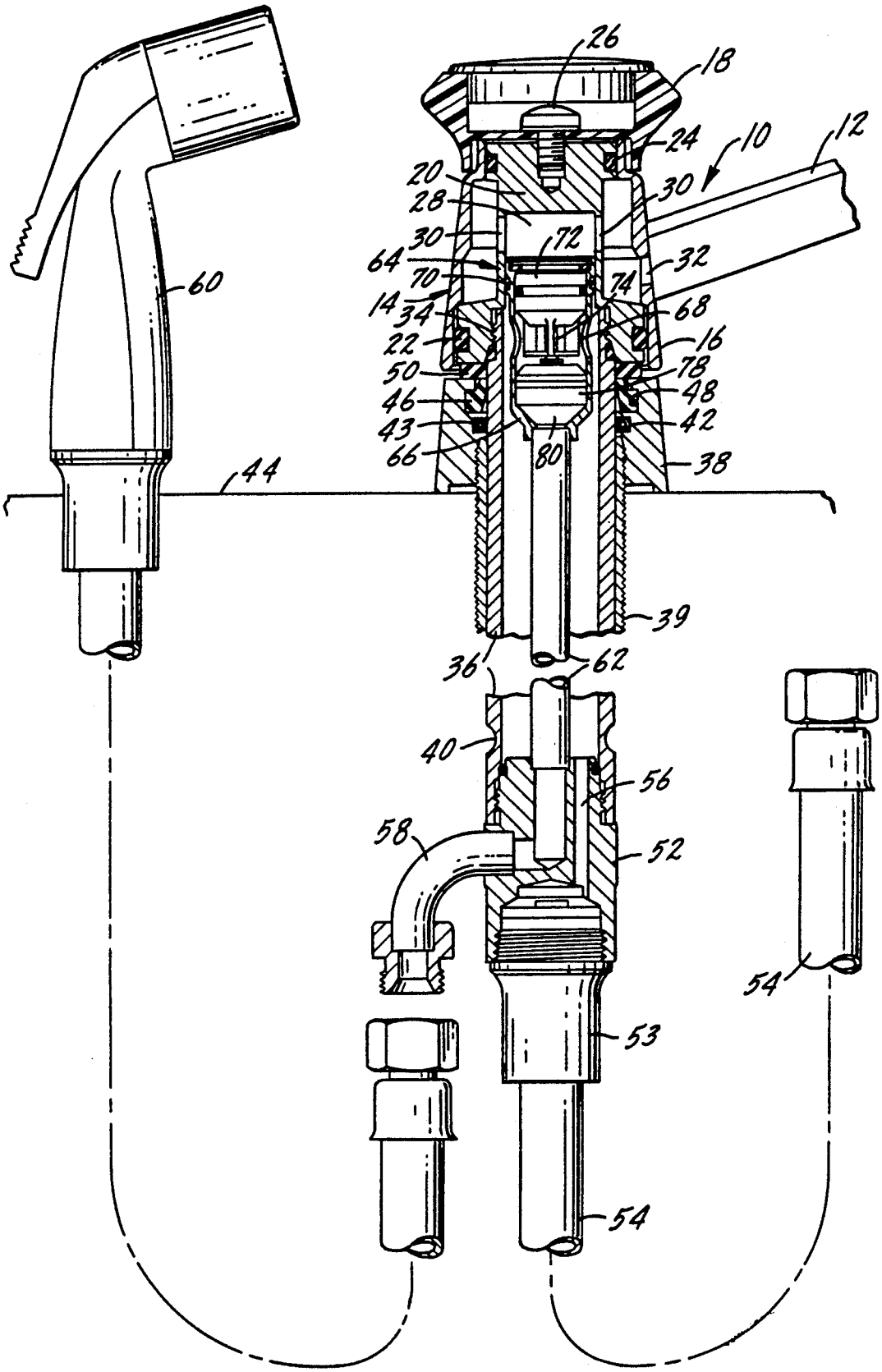
26
18
24
10
12
20
28
30
30
72
32
64
70
74
14
34
68
22
16
50
78
46
48
43
42
66
80
38
60
44
39
36
62
40
56
58
52
54
53
54

RISER SPOUT DIVERTER ASSEMBLY

SUMMARY OF THE INVENTION

The present invention relates to a rising type kitchen faucet and particularly to such a faucet assembly which includes a diverter.

A primary purpose of the invention is to provide a kitchen faucet assembly of the rising spout type, which includes a diverter mounted above the sink deck to control flow to either the spout or an auxiliary device such as a spray.

Another purpose of the invention is a rising type kitchen faucet assembly as described in which the sleeve which provides for positioning the faucet assembly mounts both the inlet and outlet water passages and a diverter assembly, with the diverter assembly being mounted above the critical level of the sink deck.

Another purpose is a simply constructed reliably operable rising type kitchen spout including a diverter assembly mounted in accordance with plumbing codes.

Other purposes will appear in the ensuing specification, drawing and claims.

BRIEF DESCRIPTION OF THE DRAWINGS

The invention is illustration diagrammatically in the attached drawing which is an axial section through a rising type spout assembly of the type described.

DESCRIPTION OF THE PREFERRED EMBODIMENTS

A faucet assembly which includes an auxiliary discharge such as a spray which may be moved so that it is immersed within the water in the sink must have the diverter assembly mounted above the flood rim and more specifically above the critical level which is at least an inch above the flood rim or overflow of the sink. In the past rising type kitchen spouts have been unable to be used with an auxiliary discharge without having a diverter assembly positioned within a separate housing in order for the diverter assembly to be above the sink deck. The present invention provides a rising type spout, with an auxiliary discharge device, in which the diverter assembly is mounted integral with the spout assembly.

In the drawing, the spout assembly is indicated generally at 10 and includes a spout 12 and a spout housing 14 which has an exterior decorative surface 16 and a cap 18. The device shown is of the type manufactured by Moen Incorporated and sold under the trademark "RISER". Spout housing 14 is mounted on a spout hub 20 which is sealed to the housing by O-rings 22 and 24. Cap 18 is secured to hub 20 by a screw 26. The hub 20 has an interior chamber 28 with windows 30 which are in communication with a spout inlet window 32 which connects to the spout 12.

Hub 20 is mounted, by a threaded connection 34, to the uppermost end of a sleeve 36 which extends downwardly from the hub and through a support base 38 and a mounting fitting 39. The exterior of sleeve 36 has a peripheral groove 40 which cooperates with a garter spring 42, positioned within a support base recess 43, to position sleeve 36 and its attached spout housing and spout at an elevated level above the sink deck 44. A bumper seal 46 positioned within a groove 48 in support base 38 bears against the exterior of sleeve 36 and prevents leakage from the sleeve through the support base. A further seal 50 may be mounted on top of support base 38 and bears against the under side of hub 20. Seals 46 and 50 prevent any leakage from the spout housing assembly. The device described so far is shown in detail in U.S. Pat. No. 4,457,342, owned by assignee of the present application.

The lower end of sleeve 36 is threadedly attached to a fitting 52 to which is connected the termination 53 of a flexible inlet conduit 54, the opposite end of which may be connected to a control valve which provides hot and cold water at inlet pressure. Fitting 52 has a plurality of circumferentially arranged inlet passages 56 which connect conduit 54 and the interior of sleeve 36. Inlet water is accordingly conveyed to the interior of the sleeve. Fitting 52 also mounts an outlet conduit 58 which is connected to a spray device 60, typically mounted on sink deck 44. Both the inlet for sleeve 36 and the outlet are attached at the bottom of the sleeve so that the sleeve may be pulled to its full extent out of support base 38 in variably positioning the spout above the sink deck.

Coaxially positioned within sleeve 36 and mounted in fitting 52 is an outlet tube 62 which is connected to outlet conduit 58 and to the lower end 80 of a diverter assembly indicated generally at 64. Diverter assembly 64 includes a diverter housing 66 having a plurality of inlet windows 68. The upper end of diverter housing 64 mounts a seal ring 70 which bears against the interior of hub 20. The upper end of housing 64 is open, providing communication with chamber 28 and thus windows 30, 32 and spout 12.

The diverter assembly includes a seat member 72 mounting a poppet valve 74. The poppet valve is formed and positioned to close upon the seat member or to be moved upwardly to permit water from inlet windows 68 to flow upwardly through the seat member and out the upper end of the diverter assembly to chamber 28. Poppet valve 74 mounts a sealing cup 78 which has an exterior flexible wall bearing against the interior of housing 64, sealing communication between windows 68 and the bottom outlet 80 which communicates with outlet tube 62.

In the normal use of the spout assembly, water from inlet conduit 54 will flow upwardly through passages 56 into the interior of sleeve 36. The water will flow upwardly through the sleeve, inwardly through diverter windows 68 and will raise the poppet valve to an upper position permitting water to pass into chamber 28. Water from the chamber can then pass through windows 30 and 32 to spout 12. When it is desired to use the spray, operation of the spray handle reduces pressure at outlet conduit 58 which draws poppet valve 74 down upon the seat member, preventing further water flow upwardly through the diverter assembly. Water pressure then inwardly flexes sealing cup 78 causing water to flow downwardly through outlet tube 62 to the spray. This operation is conventional and many diverter assemblies work in this manner.

The spout assembly may be positioned at an elevated height above support base 38. The spout housing, spout and sleeve 36 are raised upwardly, the diverter assembly moving with the spout housing until spring 42 snaps into the recess 40 on the exterior of sleeve 36. This enables the rising spout to be positioned at an elevated level above the sink to facilitate washing different types of objects.

In prior rising spout assemblies, the diverter assembly required a separate diverter housing mounted on the sink deck in order to be positioned above the critical level of the sink deck. This position for the diverter assembly is necessary by code to prevent back siphonage from the spray device through the diverter into the potable water supply. The present invention provides an integral diverter assembly, eliminating the need for a special sink top mounted housing. By positioning the diverter assembly at the upper end of sleeve 36, the diverter is above the highest level of the sink deck and the lowermost position of the diverter assembly is always above the critical level, preventing any form of back siphonage.

Whereas the preferred form and several variations of the invention have been shown, described, and suggested, it should be understood that suitable additional modifications, changes, substitutions and alterations may be made without departing from the invention's fundamental theme. It is therefore wished that the invention be unrestricted except as by the appended claims.

The embodiments of the invention in which an exclusive property or privilege is claimed are defined as follows:

1. A rising type water faucet assembly including a support base adapted to be mounted on a sink deck, a spout housing and spout mounted on said support base, an elongated sleeve extending in said support base and attached to said spout housing, said sleeve including means cooperating with said support base for releasably positioning said sleeve and spout housing at a raised height above said support base, a water inlet connected to a lower end of said sleeve, an auxiliary water outlet connected to a lower end of said sleeve, a tube in said sleeve extending generally the length thereof, a diverter assembly positioned at the upper end of said sleeve and at the upper end of said tube, said sleeve and tube providing water passages between said diverter assembly and said inlet and auxiliary water outlet, said diverter assembly being movable with said sleeve and spout housing, the lowermost position of said diverter assembly, when said spout housing is positioned directly on said support base, being above said sink deck.

2. The faucet assembly of claim 1 further characterized in that said inlet water passage and outlet water passage are coaxially arranged in said sleeve.

3. The faucet assembly of claim 2 further characterized in that said inlet water passage is positioned circumferentially about said outlet water passage.

4. The faucet assembly of claim 1 further characterized by and including a spout passage between said diverter assembly and spout, with said diverter assembly controlling communication from said inlet passage to said spout passage.

5. The faucet assembly of claim 1 further characterized in that said diverter assembly includes a housing mounted at the upper end of said tube, a plurality of inlet windows in said housing, a spout passage in said housing in communication with said spout, and a diverter valve within said housing and movable between positions connecting said inlet windows to either said tube or to said spout passage.

* * * * *